US010450799B2

(12) United States Patent
Lawler

(10) Patent No.: US 10,450,799 B2
(45) Date of Patent: Oct. 22, 2019

(54) ATTACHABLE PLATFORM

(71) Applicant: James Lawler, Windham, ME (US)

(72) Inventor: James Lawler, Windham, ME (US)

(73) Assignee: Workstation Integrated, LLC, Raymond, ME (US)

( * ) Notice: Subject to any disclaimer, the term of this patent is extended or adjusted under 35 U.S.C. 154(b) by 40 days.

(21) Appl. No.: 15/293,787

(22) Filed: Oct. 14, 2016

(65) Prior Publication Data

US 2017/0130530 A1 May 11, 2017

Related U.S. Application Data

(60) Provisional application No. 62/251,350, filed on Nov. 5, 2015.

(51) Int. Cl.

| | |
|---|---|
| ***E06C 7/14*** | (2006.01) |
| ***E06C 7/16*** | (2006.01) |
| *E06C 7/48* | (2006.01) |

(52) U.S. Cl.

CPC ..... *E06C 7/14* (2013.01); *E06C 7/16* (2013.01); *E06C 7/165* (2013.01); *E06C 7/48* (2013.01)

(58) Field of Classification Search

CPC .. E06C 7/16; E06C 7/165; B25H 3/00; B25H 3/02; B25H 3/06; A47G 23/06; A47G 23/0666

USPC ..... 182/129; D25/68

See application file for complete search history.

(56) References Cited

U.S. PATENT DOCUMENTS

| | | | | | |
|---|---|---|---|---|---|
| 2,670,260 | A | * | 2/1954 | Watt | A47G 23/06 108/129 |
| 2,897,974 | A | * | 8/1959 | Cook | A47G 23/06 108/44 |
| 2,930,442 | A | | 3/1960 | Carter | |
| 4,261,435 | A | * | 4/1981 | Winter | B25H 3/06 182/121 |
| 4,341,304 | A | * | 7/1982 | Diller | B25H 3/06 108/44 |
| 4,403,806 | A | * | 9/1983 | Stephen | A47C 15/004 108/44 |
| 4,706,918 | A | * | 11/1987 | Wilson | E06C 7/14 15/257.06 |
| 5,052,581 | A | | 10/1991 | Christ et al. | |
| 5,727,649 | A | | 3/1998 | Buckley | |
| 5,822,918 | A | * | 10/1998 | Helfman | A47G 7/044 47/39 |
| 5,836,557 | A | | 11/1998 | Bailey et al. | |
| 5,901,998 | A | | 5/1999 | Gallo | |
| 5,941,344 | A | | 8/1999 | Burns | |
| 5,950,972 | A | * | 9/1999 | Irish | E06C 7/14 182/121 |
| 5,967,259 | A | | 10/1999 | Williams | |
| D424,806 | S | * | 5/2000 | Dixon, Sr. | D3/304 |
| 6,109,435 | A | * | 8/2000 | Failor | B60R 11/06 206/373 |

(Continued)

*Primary Examiner* — Colleen M Chavchavadze

(74) *Attorney, Agent, or Firm* — Tredecim LLC; Sean L. Sweeney; Taylor A. Noonan

(57) ABSTRACT

An attachable platform providing a work surface affixed to the top cap of the ladder. The device includes a work surface and rails along the exterior edges of the work surface and slots therein. The slots receive an attachment device such as a hook and loop strap to attach the platform to the ladder. Protrusions are found on the back surface of the platform and are designed to accommodate the top cap of a ladder.

12 Claims, 9 Drawing Sheets

(56) References Cited

U.S. PATENT DOCUMENTS 6,334,509 B1 * 1/2002 Ryszkiewicz ..... B25H 3/00 182/129
6,401,862 B1 * 6/2002 Caron ..... E06C 7/14 182/120
6,443,260 B1 9/2002 Katz et al.
6,698,548 B1 3/2004 Verrill
6,786,561 B1 * 9/2004 Glenn ..... B25H 3/02 206/372
7,032,711 B1 * 4/2006 Katz ..... B25H 3/06 182/129
7,059,692 B2 * 6/2006 Glenn ..... B25H 3/02 206/372
7,207,438 B2 * 4/2007 Lieffring ..... B25H 3/06 108/143
7,264,084 B1 9/2007 Switzer
7,658,265 B1 2/2010 Dooley
7,735,800 B2 * 6/2010 Lunato ..... A47G 7/044 248/146
7,753,170 B1 * 7/2010 Gibson ..... E06C 7/14 182/107
2002/0070136 A1 * 6/2002 Hedges ..... B25H 3/00 206/373
2002/0104709 A1 8/2002 Hines
2004/0163891 A1 * 8/2004 Craig ..... E06C 1/39 182/129
2007/0205052 A1 9/2007 Dawson
2009/0032662 A1 * 2/2009 Parrott ..... E06C 7/14 248/238
2009/0095568 A1 * 4/2009 Webster ..... E06C 7/14 182/129
2009/0283361 A1 * 11/2009 Gibson ..... E06C 7/14 182/129
2013/0112502 A1 * 5/2013 Oliver ..... E06C 7/14 182/129
2014/0332316 A1 * 11/2014 Tiber ..... B26D 7/01 182/129

* cited by examiner

ATTACHABLE PLATFORM

CROSS-REFERENCE TO RELATED APPLICATION

This application is a nonprovisional application and claims the right of priority to U.S. patent application Ser. No. 62/251,350 filed on Nov. 5, 2015 and incorporates the same as if fully rewritten herein.

TECHNICAL FIELD

Exemplary embodiments of the present invention are directed to an attachable platform. More particularly, exemplary embodiments of the present invention relate to an attachable platform for use with various types of ladders.

BACKGROUND OF THE ART

One of the most common tools on any jobsite is a ladder. Whether the job is indoors or outdoors, painting to electrical, ladders are used to reach heights otherwise inaccessible. From humble beginnings thousands of years ago the ladder has progressed over the years branching out into a multitude of specialty ladders for nearly every application.

Although ladders are ever evolving, the same original concern persists. How safe is the ladder? Manufacturers have addressed this concern in a variety of ways over the years, reinforcements, extra braces, clips and harnesses, but present innovations have failed to address one of the biggest safety concerns facing ladder users—themselves. In decreasing the failure rate of ladders, it is often forgotten that atop a ladder an individual is trying to perform work with little to no area on which to perform such work. Often a worker will have to ascend and descend the ladder several times in order to complete simple tasks that could have been accomplished in a single trip had there been enough space to perform such work. Additionally, if the worker attempts to perform the task without the needed area, he or she may mishandle a tool or material, dropping it, and placing those below the ladder at risk for injury.

Consequently, there is a need for a device that provides a user with sufficient workspace to complete tasks without the need to continually ascend and descend a ladder, which is easily attachable to most stepladders, and allows a user to take full advantage of the height of the ladder.

SUMMARY OF THE INVENTIVE CONCEPT

An exemplary embodiment of the attachable platform described herein provides an easily attachable workspace designed to securely fasten to the top cap of stepladders. This provides several advantages over existing platform attachments for the ladder, in that by attaching to the top cap of the ladder, the full height of the ladder is available to user. Additionally, traditional platforms extended outward toward the user on lower rungs with bracing to support the extended platform. This traditional design is dangerous as anything extending toward the user may cause the user to loose his or her balance and fall from the ladder. Additionally, the size of these traditional platforms has been significantly limited by these concerns and often do not provide the user with sufficient space on which to work. The inventive attachable platform herein eliminates these safety concerns and provides a sufficient work area without sacrificing the safety of the user.

Exemplary embodiments of the attachable platform include a work surface. The work surface may be symmetrical or asymmetrical depending on the application. In addition, the work surface may be rectangular or some other shape befitting the job. Rails may be placed around the exterior edge of the work surface in order to prevent tools or other materials from rolling off the work surface. The work surface may have a flat construction or it may be slightly concave in order to ensure that tools or materials placed on the work surface remain on the work surface.

The exemplary embodiments of the attachable platform will have protrusions extending from the underside of the work surface are arranged to surround the top cap of the ladder. The protrusion will be arranged such that the top cap of the ladder will nest within the configuration formed by the protrusions. The protrusions can be molded with the work surface as a single unitary piece or they may be separate pieces affixed to the underside of the work surface. The size of the protrusions is sufficient to ensure that the work surface does not slide once fitted atop the top cap of the ladder. The protrusions are also arranged so that the work surface of the attachable platform only minimally intrudes into the work area of the user.

In other exemplary embodiment, the underside of the work surface may have slots therein adapted to receive the protrusions. Once inserted into the slots, the protrusions may be adjusted in order to fit a variety of ladder top cap sizes. The protrusions may be moved by a ratcheting device or other mechanical device able to apply force to the protrusions. The ability to adjust the areas defined by the protrusions allows exemplary embodiments of the attachable platform to be used on ladders designed and developed by different manufacturers.

In still other exemplary embodiments, the platform may have a magnetic strip running along the perimeter of the work surface. Openings may also be provided in the work surface to accommodate containers. Hinged lids may be provided to keep the containers closed and their contents secure. The openings may be sized so that when a container is retained therein, the lid of the container sits flush with the work surface. A grid support may be used on the back surface to provide the platform with rigidity. The protrusions for receiving the top cap of a ladder may also be designed to accommodate various sized ladders. Accordingly the protrusions may consist of an outer rectangle and an inner rectangle, wherein the outer rectangle extends further from the back surface then does the inner rectangle. This allows various sized ladder top caps to be securely nested into the protrustions.

The work surface will also have an opening therein allowing for an attachment device to be inserted therein. In one exemplary embodiment the opening is a slot able to accommodate a hook and loop strap. The hook and loop strap could be threaded through the opening and around the top cap of the ladder to securely fasten the platform to the ladder. In other exemplary embodiments a mechanical fastener may be used to secure the platform to the top cap of the ladder.

BRIEF DESCRIPTION OF THE DRAWINGS

The advantages and other characteristics of the disclosed embodiments will be better understood when attention is directed to the accompanying drawings, wherein identical elements are identified with identical reference numerals and wherein.

DETAILED DESCRIPTION OF THE EXEMPLARY EMBODIMENT(S)

Exemplary embodiments of the present invention will now be described in greater detail. It should be recognized that the present invention can be practiced in a wide range of other embodiments besides those explicitly described, and the scope of the exemplary embodiments described are expressly not limited.

Figure 1:
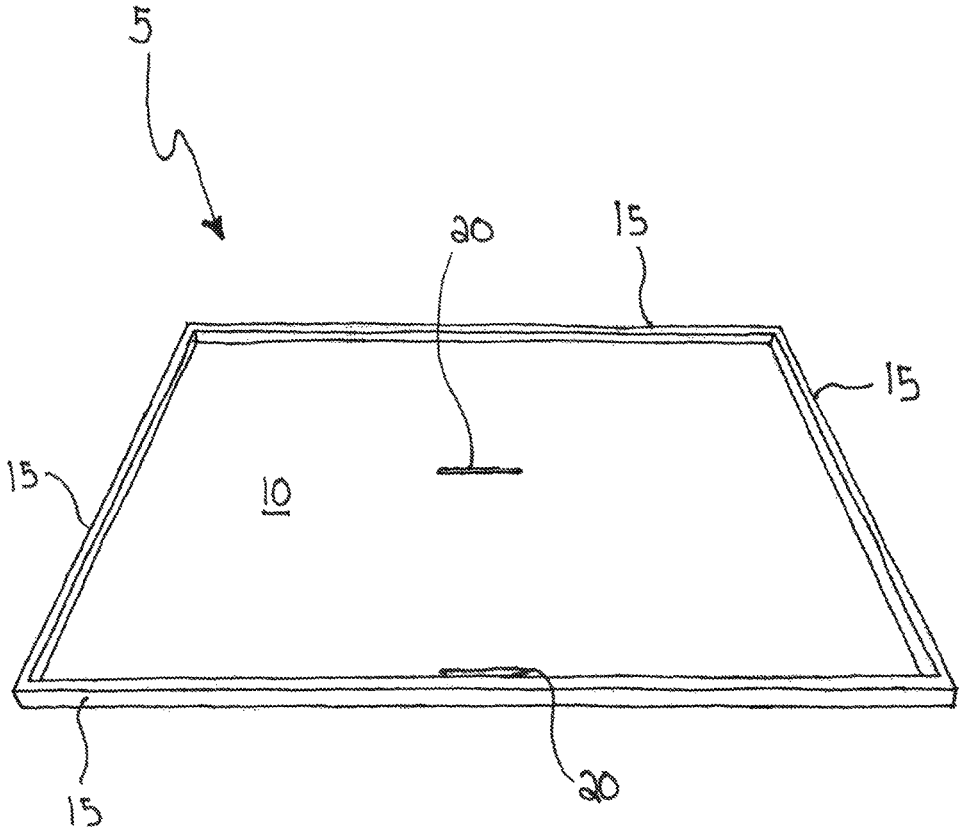
FIG. 1 is a top perspective view of an exemplary embodiment of the inventive attachable platform.
Figure 2:
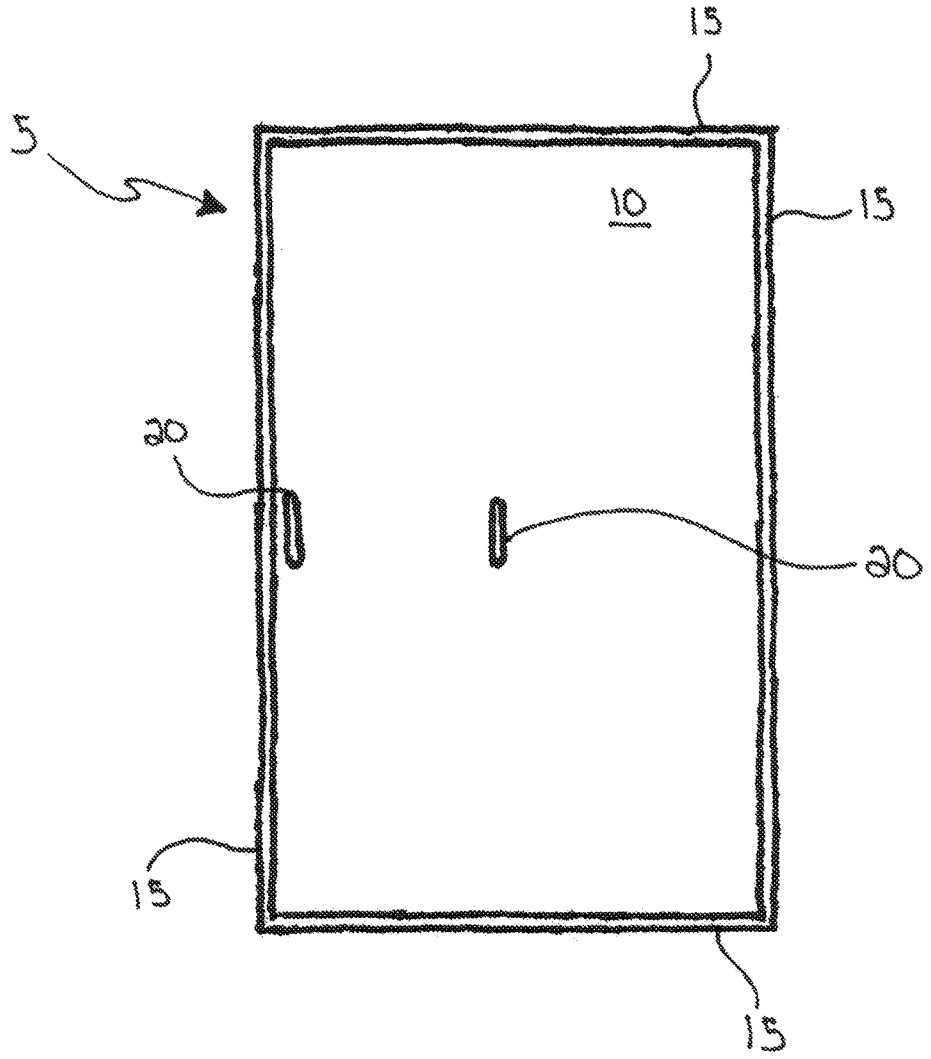
FIG. 2 is a top view of an exemplary embodiment of the inventive attachable platform illustrating the openings defined therein.

Directing attention to the drawings and particularly to FIGS. 1 and 2, a top view and a top perspective view are provided of an exemplary embodiment of the attachable platform 5. As illustrated, the exemplary platform 5 includes a work surface 10 having rails 15 along the exterior edges of the work surface 10 and extending normally therefrom. As shown, the work surface has a substantially rectangular shape; however, it should be understood by those of skill in the art that the work surface 10 could have any shape. The work surface 10 can be made from a variety of materials such as wood, plastic, metal, or any other organic or synthetic material having characteristics allowing it to function as a rigid work surface 10.

To allow for additional safety, all or portions of the work surface 10 may be coated with a non-slip material to prevent tools and other materials from falling from the platform work surface 10. The rails 15 extending from the work surface 10 are also sufficiently sized to prevent tools and materials from falling from the platform 5. The work surface 10 may be flat or it may be slightly concave in order to ensure that any tools or material fall onto the work surface 10 rather than off the edges of the work surface 10.

The work surface 10 further defines slots 20 therein. The slots 20 are provided to allow an attachment device to be threaded through the slots 20 and around the top cap of a ladder to attach the platform to a ladder. The slots 20 are positioned so as to allow the platform 5 to be affixed to the ladder and not impinge on the work area of a user while on the ladder.

Figure 3:
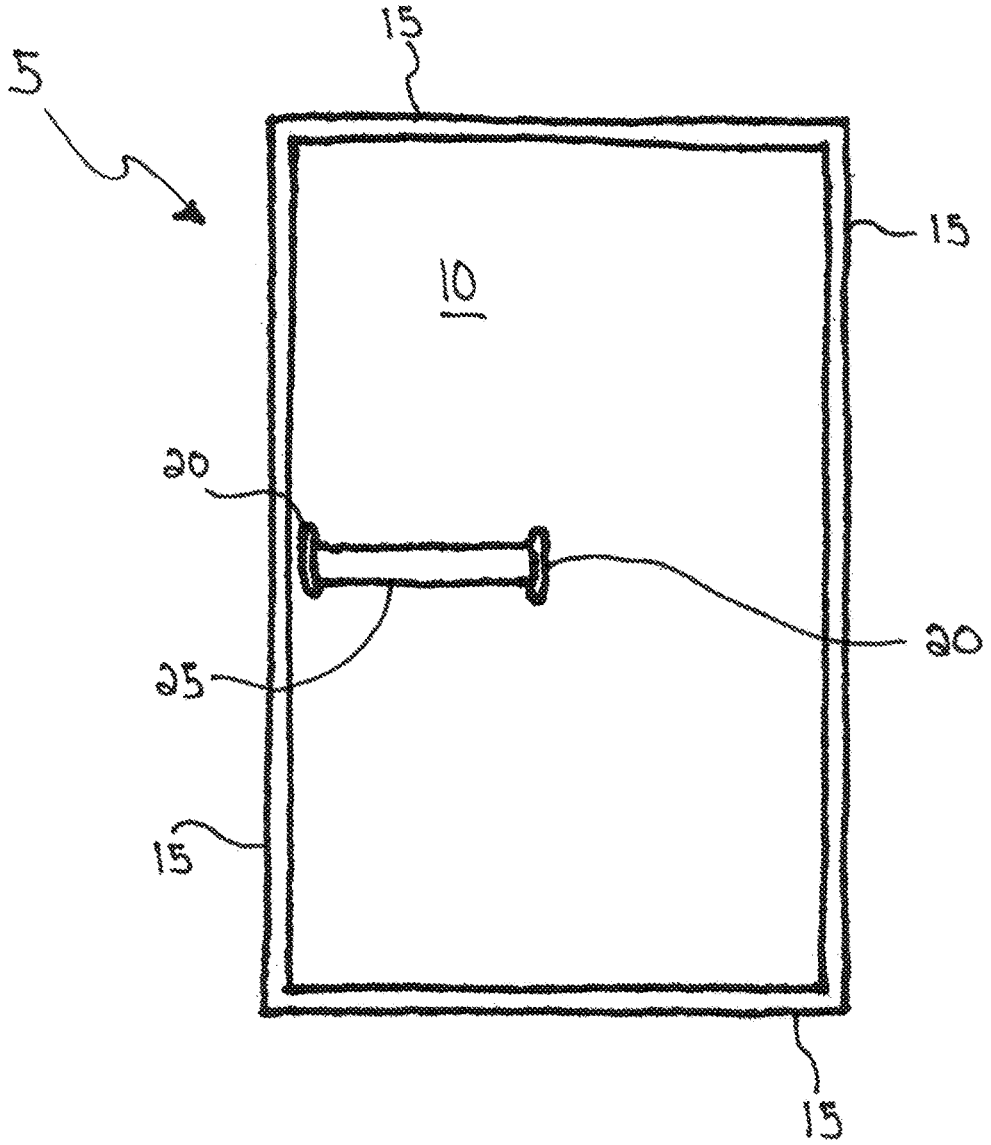
FIG. 3 is a top perspective view of an exemplary embodiment of the inventive attachable platform having an attachment device threaded through the openings defined therein.

As illustrated in FIG. 3, the attachment device 25 is threaded though the slots 20. After being threaded through the slots 20, the attachment device 25 is then wrapped around the top cap of a ladder to securely affix the platform 5 to the ladder. The attachment device 25 may be a hook and loop fastener. In other exemplary embodiments, the attachment device 25 may be a ratcheting device or other similar mechanical fastener sufficient to affix the platform 5 to the top cap of a ladder.

Figure 4:
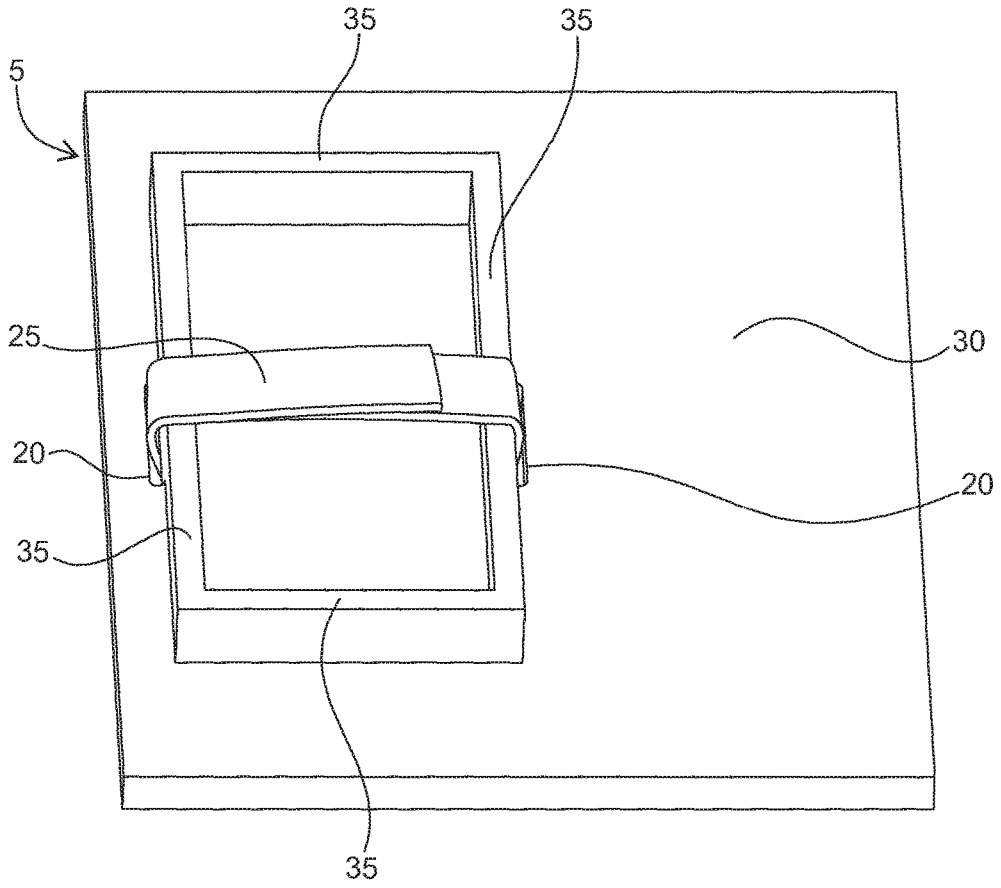
FIG. 4 is a bottom view of an exemplary embodiment of the inventive attachable platform having an attachment device.

The underside of the platform 5 is illustrated in FIG. 4. As shown, the work surface 10 has a back surface 30. A series of protrusions 35 extend normally from the back surface 30. The protrusions 35 are arranged in a rectangular pattern having an interior dimension sufficient to surround the top cap of a ladder. Accordingly, the positioning of the protrusions 35 may be adjusted to fit a variety of ladder top caps. The protrusions 35 are sufficiently sized to prevent the platform 5 from sliding when placed atop the ladder top cap. The slots 20 extending through the back surface 30 allowing an attachment device 25 to be threaded therein. As illustrated the attachment device 25 is a hook and loop strap that allows the platform 5 to be securely fastened to the ladder top cap. Although shown as separate pieces affixed to the back surface 30, the protrusions 35 may be molded with the back surface 30 to have a single unitary design. Likewise the rails 15 found on the working surface 10 may also be molded with the working surface 10 and have a single unitary design. In embodiments having a unitary design, the slots 20 would also be molded into the working surface 10 and back surface 30 during manufacturing. Having a unitary design would eliminate the number of components on the inventive platform 5 that could malfunction.

Figure 5:
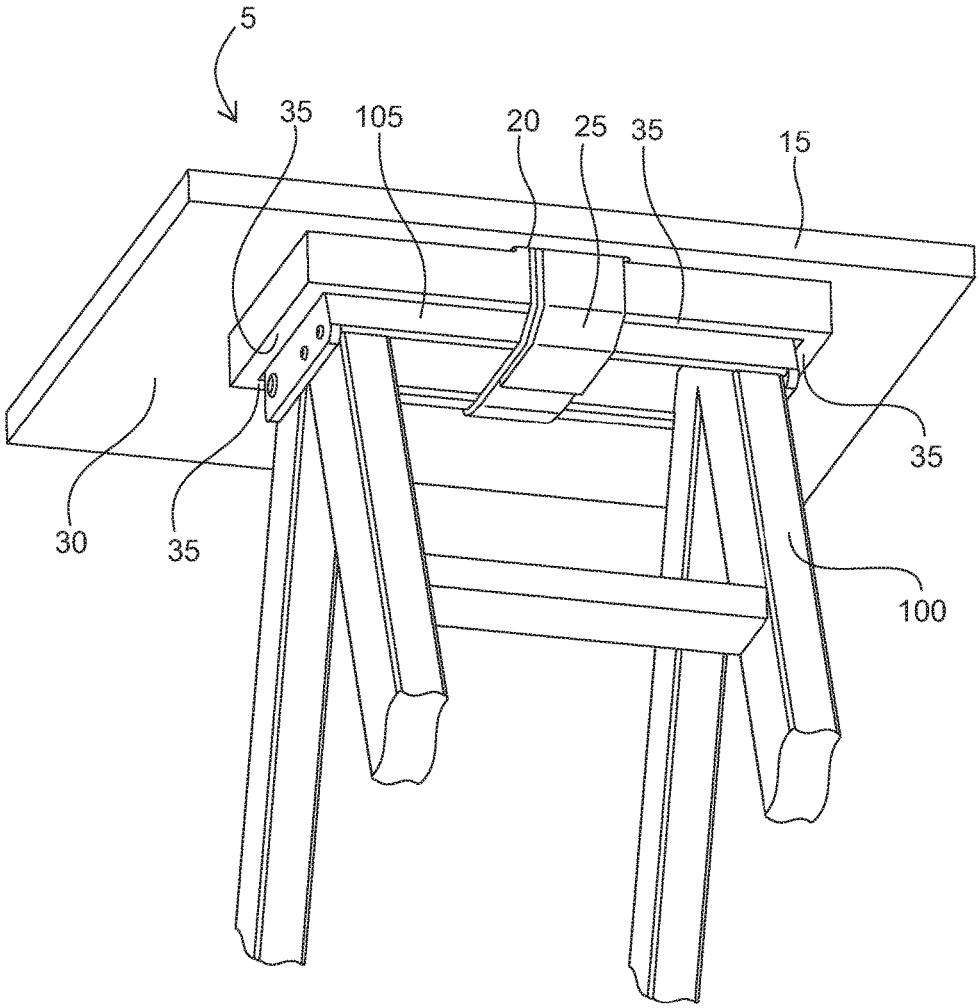
FIG. 5 is a bottom perspective view of an exemplary embodiment of the inventive attachable platform attached to the top cap of a ladder.
Figure 6:
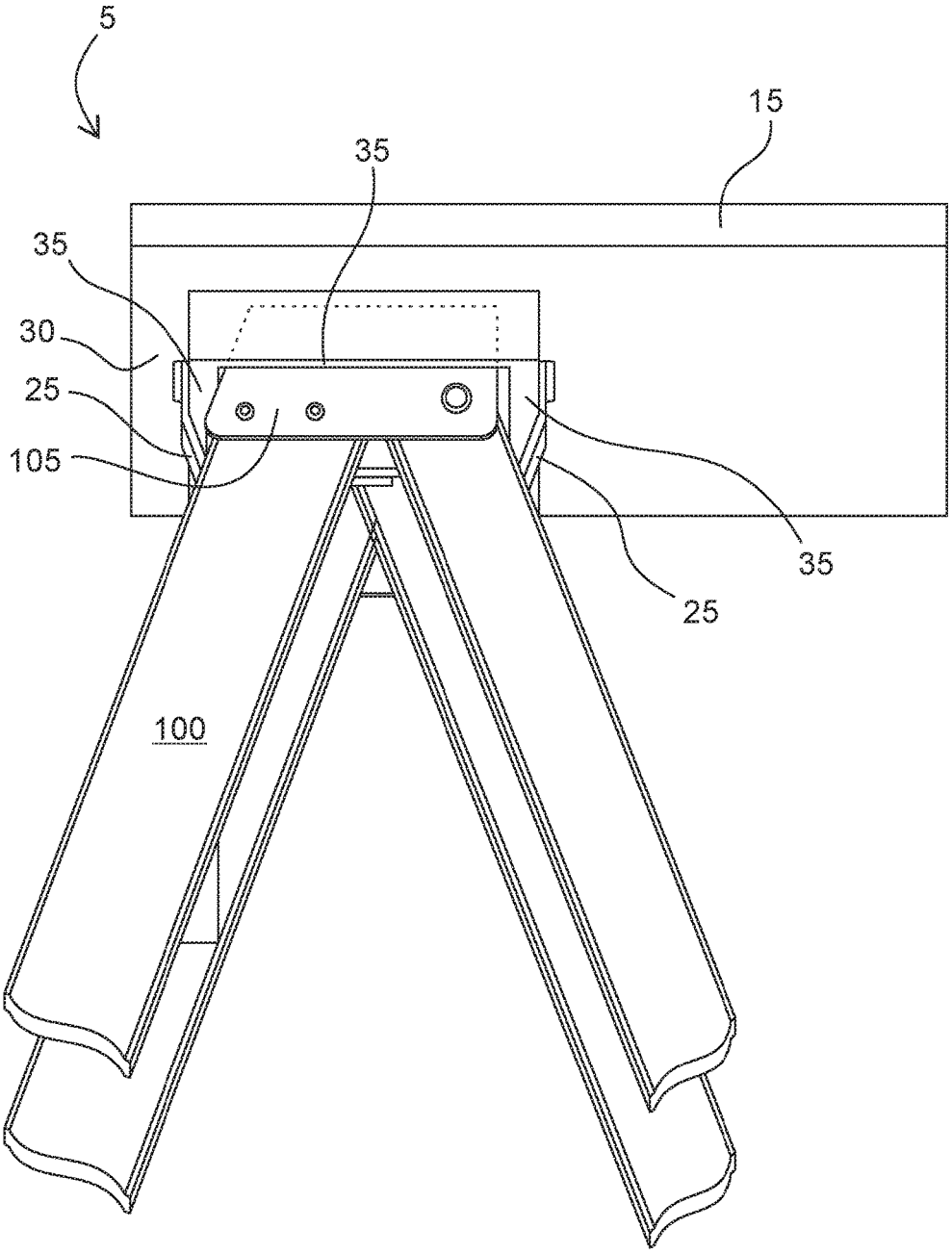
FIG. 6 is a side perspective view of an exemplary embodiment of the inventive attachable platform as attached to the top cap of a ladder.

FIGS. 5 and 6 illustrate an exemplary embodiment of the platform 5 attached to a top cap 105 of a ladder 100. As shown, the top cap 105 of the ladder 100 nests into the space created by the protrusions 25. This nesting feature prevents the platform 5 from sliding when the platform 5 is affixed to the ladder 100. Once the top cap 105 is placed within the cavity created by the protrusions 25, the attachment device 25 is wrapped around the top cap 105 and the attachment device 25 is used to secure the platform 5 to the top cap 105. As illustrated, the attachment device 25 is a hook and loop strap, but it should be understood that ratcheting devices or other mechanical devices may be used to affix the platform 5 to the ladder 100.

FIGS. 5 and 6 also illustrate an additional feature of the inventive platform 5. As shown, while the platform 5 is affixed to the ladder 100, the majority of the work surface 10 extends away from the user. This prevents the platform 5 from extending into the users work space and allows the user to better maintain his or her balance while atop the ladder 100.

Figure 7:
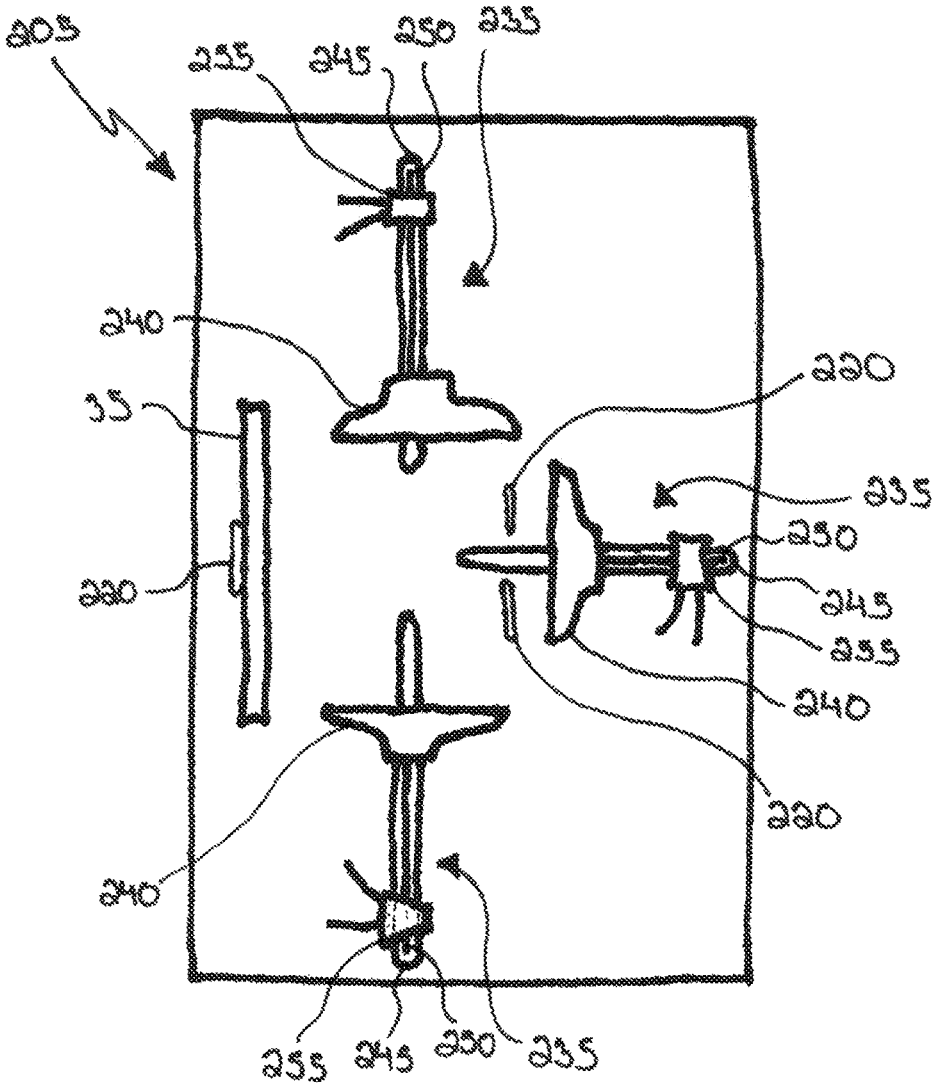
FIG. 7 is bottom perspective view of another exemplary embodiment of the inventive attachable platform.

FIG. 7 shows another exemplary embodiment of the attachable platform 205. In this embodiment, the adjustable clamps 235 are used in place of three of the standard protrusions 35. As shown, the platform 5 has a back surface 230 with slots 220 therein. As with other embodiments, the slots 220 are used to receive attachment devices 25, such as hook and loop straps, to affix the platform 205 to a ladder.

To prevent the platform 205 from sliding off the top cap 105 of a ladder, this embodiment includes a protrusion 35 and a series of clamps 235. The clamps 235 include a clamp block 240. The clamp blocks 240 are affixed to the platform 205 by being inserted into channels 245 found in the back surface 230 of the platform 205. The clamping blocks 240 can be moved into position to contact a top cap 105 of a ladder 100 by using rod 250 in communication with the clamping block 240 and a handle 255. The handle 255 is designed to extend or retract the clamping block 240. In still other exemplary embodiments the clamping blocks 240 may have an attached friction lock allowing the clamping block 240 to be locked into place inside the channels 245.

Figure 8:
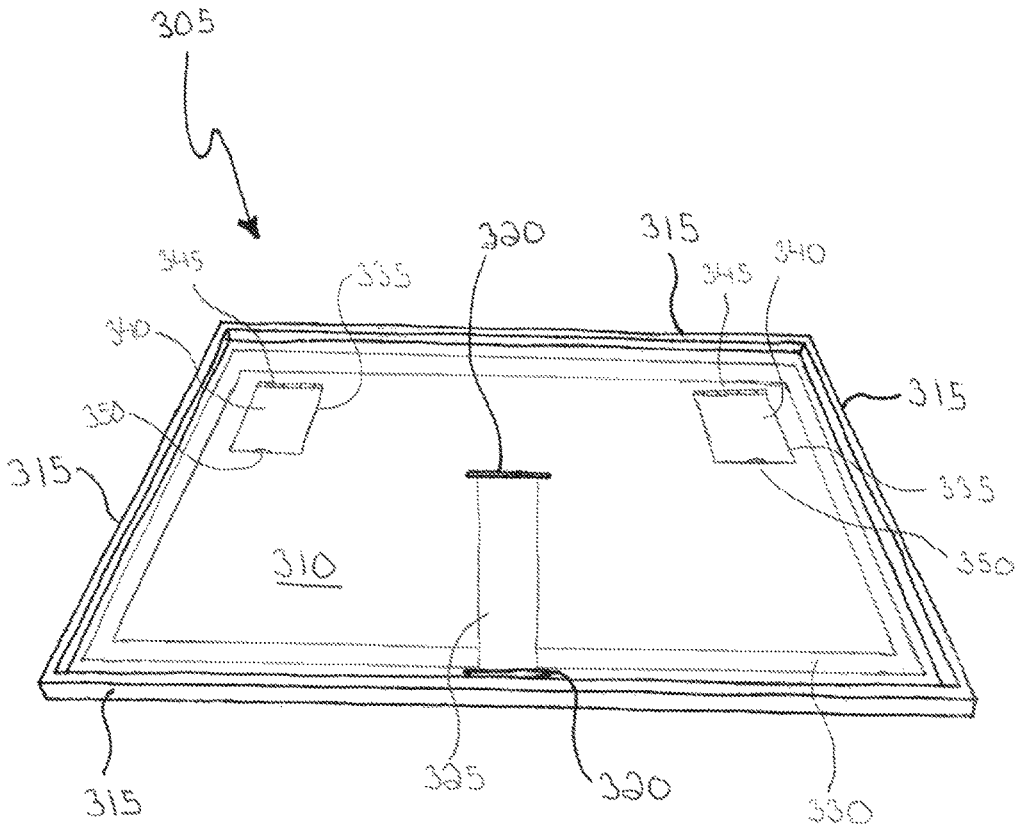
FIG. 8 is a top perspective view of another exemplary embodiment of the inventive attachable platform.

Directing attention to FIG. 8 a top perspective view of another exemplary embodiment of the attachable platform 305 is illustrated. As provided, the exemplary platform 305 includes a work surface 310 having rails 315 along the exterior edges of the work surface 310 and extending normally therefrom. The work surface 310 has a substantially rectangular shape; however it should be understood by those of skill in the art that the work surface 310 could have any shape. The work surface 310 can be made of a variety of materials such as wood, plastic, metal, or any other organic or synthetic material having characteristics allowing it to function as a rigid work surface 310.

To allow for additional safety, all or portions of the work surface 310 may be coated with a non-slip material to prevent tools or other materials from falling from the platform work surface 310. The rails 315 extending from the work surface 310 are also sufficiently sized to prevent tools and materials from falling from the platform 305. The work surface 310 may be flat or it may slightly concave in order to ensure that any tools or material fall onto the work surface 310 rather than off the edges of the work surface 310. As with other embodiments, the work surface further defines slots 320 therein. The slots 320 are provided to allow an attachment device 325 to be threaded there through and around the top cap of a ladder to attach the platform 305 to a ladder. The slots 320 are positioned to allow the platform 305 to be attached to the ladder and not impinge on the work area of the user while positioned on the ladder.

This embodiment of the platform 305 also includes a magnetic strip 330 positioned around the outside of the work surface 310 just inside the rails 315. The magnetic strip 330 provides another layer of protection to prevent tools or materials from escaping the work surface 310. This embodiment of the platform 305 also includes containers 350 shown in FIG. 9.

To access these containers 370 openings 335 are provided in the work surface 310. The size of the openings 335 are such to allow the containers 370 and the lids 340 covering the containers to be flush mounted with the work surface 310. Hinges 345 are provide to allow the lids 340 to be lifted through the use of thumbnail latches 350 on the lids 340. The use of the containers 370 allows a user to store materials, tools or other materials freeing up space on the work surface 310.

Figure 9:
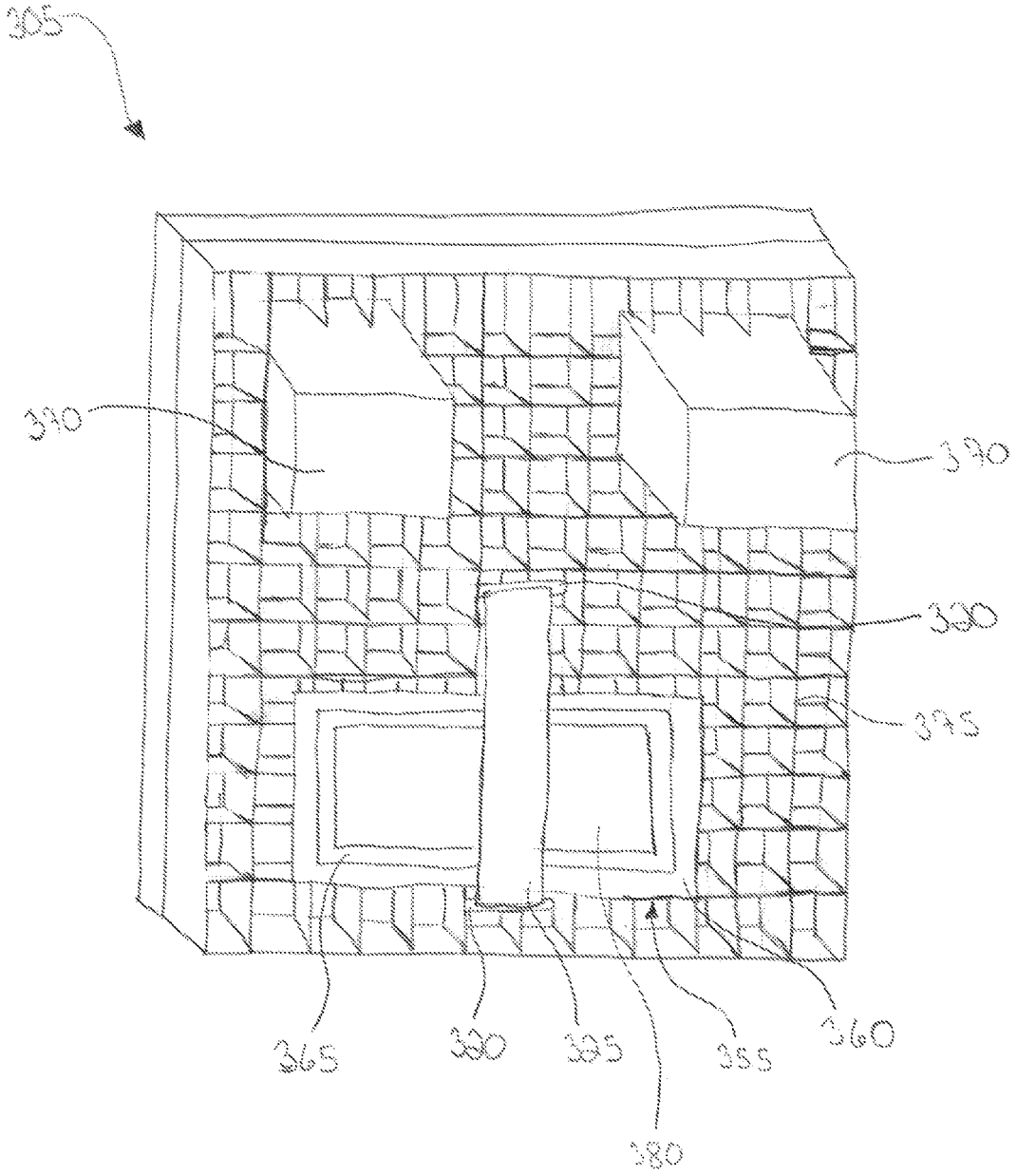
FIG. 9 is a bottom perspective view of the exemplary embodiment of the inventive attachable platform of FIG. 8.

Moving now to FIG. 9 a bottom perspective view of the platform 305 is illustrated. As shown in FIG. 9, this embodiment has a series of protrusions 355 arranged in a rectangular pattern. The protrusions 355 have an outer 360 rectangle and an inner rectangle 365. The outer rectangle 360 encloses a larger area then does the inner rectangle 365. In order to accommodate multiple sizes of ladder top caps the outer rectangle 360 extends further from a back surface 380 of the platform 305, then does the inner rectangle 365. By providing multiple sizes through the use of an inner rectangle 365 and an outer rectangle 360, the protrusions 355 can provide a secure fit for a variety of ladder top caps. This secure fit decreases the likelihood of the platform 305 sliding on top of the ladder, which might result in injury.

As with other embodiments the slots 320 extend through the back surface 380 allowing an attachment device 325 to be threaded therein. The containers 370 are aligned with the openings 335 (shown in FIG. 8) and extend outward from the back surface 380. To provide stability to the platform 305 a grid support system 375 is provided on the back surface 380. The grid support system 375 run parallel from opposing sides of the platform 305 in two directions. Thus, the grid support system 375 runs from front to back and from side to side. Although the embodiment shown in FIGS. 8 and 9 has features not found in the embodiment shown in FIGS. 1-6, one of skill in the art should appreciate that features such as the containers 370, openings 335, series of protrusions 355, grid support system 375 may be used in with the embodiments shown in FIGS. 1-6.

While the embodiments disclosed described the best modes known to the inventor at the time of filing, the scope of the invention is not to be limited to only the embodiments disclosed herein.

What is claimed is:

1. An attachable platform comprising:

a. a work surface, wherein the underside of the work surface is a back surface;

b. one or more rails positioned along a length of the perimeter of the work surface, the one or more rails extending above the work surface;

c. a pair of slots defined by the work surface, wherein an attachment device is threaded through the pair of slots;

d. a first plurality of protrusions extending below the back surface and defining a first rectangular area, wherein the first plurality of protrusions is disposed along each of the four sides of the perimeter of the first rectangular area and are configured to surround a first ladder top cap, such that the first ladder top cap nests into the first rectangular area and the first plurality of protrusions prevents the attachable platform from sliding when the attachable platform is affixed to the first ladder top cap; and e. a second plurality of protrusions extending below the back surface and defining a second rectangular area, wherein the second plurality of protrusions is disposed along each of the four sides of the perimeter of the second rectangular area and is configured to surround a second ladder top cap, such that the second ladder top cap nests into the second rectangular area and the second plurality of protrusions prevents the attachable platform from sliding when the attachable platform is affixed to the second ladder top cap, wherein the second rectangular area partially overlaps the first rectangular area, and wherein the length and width of the second rectangular area is larger than the length and width of the first rectangular area.

2. The attachable platform of claim 1, wherein the one or more rails are positioned along the entire length of the perimeter of the work surface.

3. The attachable platform of claim 1, further comprising at least one container retained in an opening defined by the work surface, wherein the at least one container includes a hinged lid, the hinged lid being flush with the work surface when the hinged lid is in the closed position.

4. The attachable platform of claim 1, further comprising a grid support system extending from the back surface.

5. The attachable platform of claim 1, wherein the attachment device is a hook and loop strap.

6. The attachable platform of claim 1, wherein the attachment device includes a ratchet.

7. The attachable platform of claim 1, wherein each protrusion of the first plurality of protrusions extends an equal distance from the back surface.

8. The attachable platform of claim 1, wherein each protrusion of the second plurality of protrusions extends an equal distance from the back surface.

9. The attachable platform of claim 1, wherein the first plurality of protrusions are disposed along the entirety of all four sides of the perimeter of the first rectangular area.

10. The attachable platform of claim 1, wherein the second plurality of protrusions are disposed along the entirety of all four sides of the perimeter of the second rectangular area.

11. The attachable platform of claim 9, wherein the second plurality of protrusions are disposed along the entirety of all four sides of the perimeter of the second rectangular area.

12. The attachable platform of claim 1, wherein a plurality of the first plurality of protrusions and a plurality of the second plurality of protrusions are connected such that they form a plurality of stepped protrusions.

* * * * *